US012090537B2

(12) United States Patent
Robbins et al.

(10) Patent No.: US 12,090,537 B2
(45) Date of Patent: Sep. 17, 2024

(54) DUMMY BLOCK FOR EXTRUSION PRESS

(71) Applicant: Exco Technologies Limited, Markham (CA)

(72) Inventors: Paul H. Robbins, Markham (CA); Steve Johnson, Markham (CA)

(73) Assignee: Exco Technologies Limited, Markham (CA)

( * ) Notice: Subject to any disclaimer, the term of this patent is extended or adjusted under 35 U.S.C. 154(b) by 0 days.

(21) Appl. No.: 18/083,122

(22) Filed: Dec. 16, 2022

(65) Prior Publication Data

US 2024/0198403 A1 Jun. 20, 2024

(51) Int. Cl.
*B21C 26/00* (2006.01)
*B21C 23/21* (2006.01)

(52) U.S. Cl.
CPC ..... *B21C 26/00* (2013.01); *B21C 23/212* (2013.01)

(58) Field of Classification Search
CPC ..... B21C 26/00; B21C 23/212
USPC ..... 72/273
See application file for complete search history.

(56) References Cited

U.S. PATENT DOCUMENTS

| | | | | |
|---|---|---|---|---|
| 5,771,734 | A * | 6/1998 | Robbins | B21C 26/00 72/273 |
| 10,549,328 | B2 * | 2/2020 | Robbins | B21C 25/06 |
| 2013/0247640 | A1 * | 9/2013 | Heydasch | B21C 26/00 72/273 |
| 2015/0336148 | A1 * | 11/2015 | Robbins | B21C 26/00 72/253.1 |

* cited by examiner

*Primary Examiner* — Mohammed S. Alawadi

(57) ABSTRACT

A dummy block for a metal extrusion press includes: a generally cylindrical base having a forward surface and an outwardly extending circumferential flange; an expandable collar coupled to the base, the collar having an inwardly extending circumferential rib abutting the circumferential flange; a plunger disc seated against the forward surface of the base and accommodated by the collar, and a plunger shaft extending through the plunger disc and coupled to the base.

10 Claims, 6 Drawing Sheets

DUMMY BLOCK FOR EXTRUSION PRESS

FIELD

The present invention relates generally to extrusion and in particular, to a dummy block for an extrusion press.

BACKGROUND

Metal extrusion presses are known in the art, and are used for forming extruded metal products having cross-sectional shapes that generally conform to the shape of the extrusion dies used. A typical metal extrusion press comprises a generally cylindrical container having an outer mantle and an inner tubular liner. The container serves as a temperature controlled enclosure for a billet during extrusion. An extrusion ram is positioned adjacent one end of the container. The end of the extrusion ram abuts a dummy block, which in turn abuts the billet allowing the billet to be advanced through the container. An extrusion die is positioned adjacent the opposite end of the container.

During operation, once the billet is heated to a desired extrusion temperature (typically 800-900° F. for aluminum), it is delivered to the extrusion press. The extrusion ram and dummy block are then advanced, so as to push the billet through the container and towards the extrusion die. Under the pressure exerted by the advancing extrusion ram and dummy block, the billet is extruded through the profile provided in the extrusion die until all or most of the billet material is pushed out of the container, resulting in the extruded product.

Dummy blocks for extrusion presses have been previously described. For example, U.S. Pat. No. 5,918,498 to Robbins discloses a dummy block having a dummy block base, a connector for connecting the dummy block base to a stem of an extruder, a replaceable wear ring connected to a forward circumferential portion of the dummy block base, a device for releasably securing the wear ring to the dummy block base, and a device for expanding the ring to engage an inside wall of a container of an extrusion press during extrusion. The wear ring is a metal collar having a conical interior surface converging towards the dummy block base. The device for expanding the ring comprises a metal plunger having a plunger head with a conical surface for engaging the collar conical surface to expand the collar as the plunger head is forced into the collar during extrusion. The converging surfaces of the collar and the plunger head extend a sufficient distance to permit telescoping of the plunger head into the collar to an extent whereby the collar is expanded to engage the inside wall of the container.

U.S. Pat. No. 9,839,950 to Robbins discloses a dummy block for a metal extrusion press comprising: a base having a first surface; an expandable collar seated against the base; a moveable plunger coupled to the base and accommodated by the collar, the plunger having a second surface configured to abut against the first surface of the base; and an outer connecting ring coupling the collar to the base. The connecting ring comprises at least one feature engaging the base and a plurality of fingers engaging the collar.

U.S. Pat. No. 10,549,328 to Robbins discloses a dummy block for a metal extrusion press comprising: a generally cylindrical base having a forward surface and an outwardly extending circumferential flange; an expandable collar coupled to the base, the collar having an inwardly extending circumferential rib abutting the circumferential flange; a collar support coupled to the base and abutting the collar; and a moveable plunger coupled to the base and accommodated by the collar. The plunger has a rear surface configured to abut the forward surface of the base.

Improvements are generally desired. It is therefore an object at least to provide a novel dummy block for an extrusion press.

SUMMARY

In one aspect, there is provided a dummy block for a metal extrusion press comprising: a generally cylindrical base having a forward surface and an outwardly extending circumferential flange; an expandable collar coupled to the base, the collar having an inwardly extending circumferential rib abutting the circumferential flange; a plunger disc seated against the forward surface of the base and accommodated by the collar; and a plunger shaft extending through the plunger disc and coupled to the base.

The plunger disc and the plunger shaft may be separate components.

The plunger shaft may have a cylindrical portion and a frustoconical portion, the cylindrical portion and the frustoconical portion defining an obtuse angle therebetween.

The plunger disc may have a beveled bore formed therein, the beveled bore being shaped to receive the plunger shaft. The beveled bore may define a frustoconical surface, and wherein the plunger shaft may have a frustoconical portion configured to abut the frustoconical surface of the beveled bore of the plunger disc.

The collar may comprise a rear portion coupled to the base, and a forward portion configured to elastically deform outwardly. The wall thickness of the rear portion may be greater than a wall thickness of the forward portion. The forward portion may abut an outer surface of the plunger disc.

The forward surface of the base may comprise a planar central portion, and a beveled portion surrounding the central portion. The plunger disc may have a rear surface that is parallel to the planar central portion of the forward surface of the base. The rear surface may be non-parallel to the beveled portion of the forward surface of the base.

In one embodiment, there is provided a metal extrusion press comprising the dummy block as described above.

BRIEF DESCRIPTION OF THE DRAWINGS

Embodiments will now be described more fully with reference to the accompanying drawings in which.

DETAILED DESCRIPTION OF EMBODIMENTS

Figure 1:
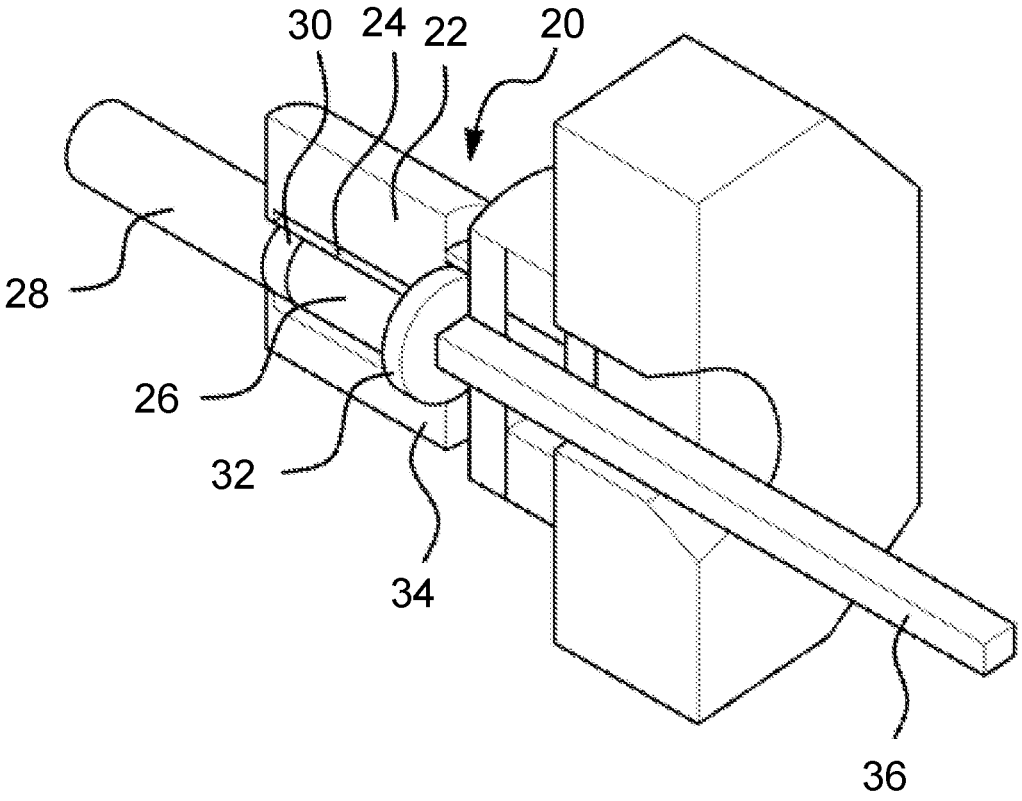
FIG. 1 is a schematic perspective view of a metal extrusion press.
Figure 2:
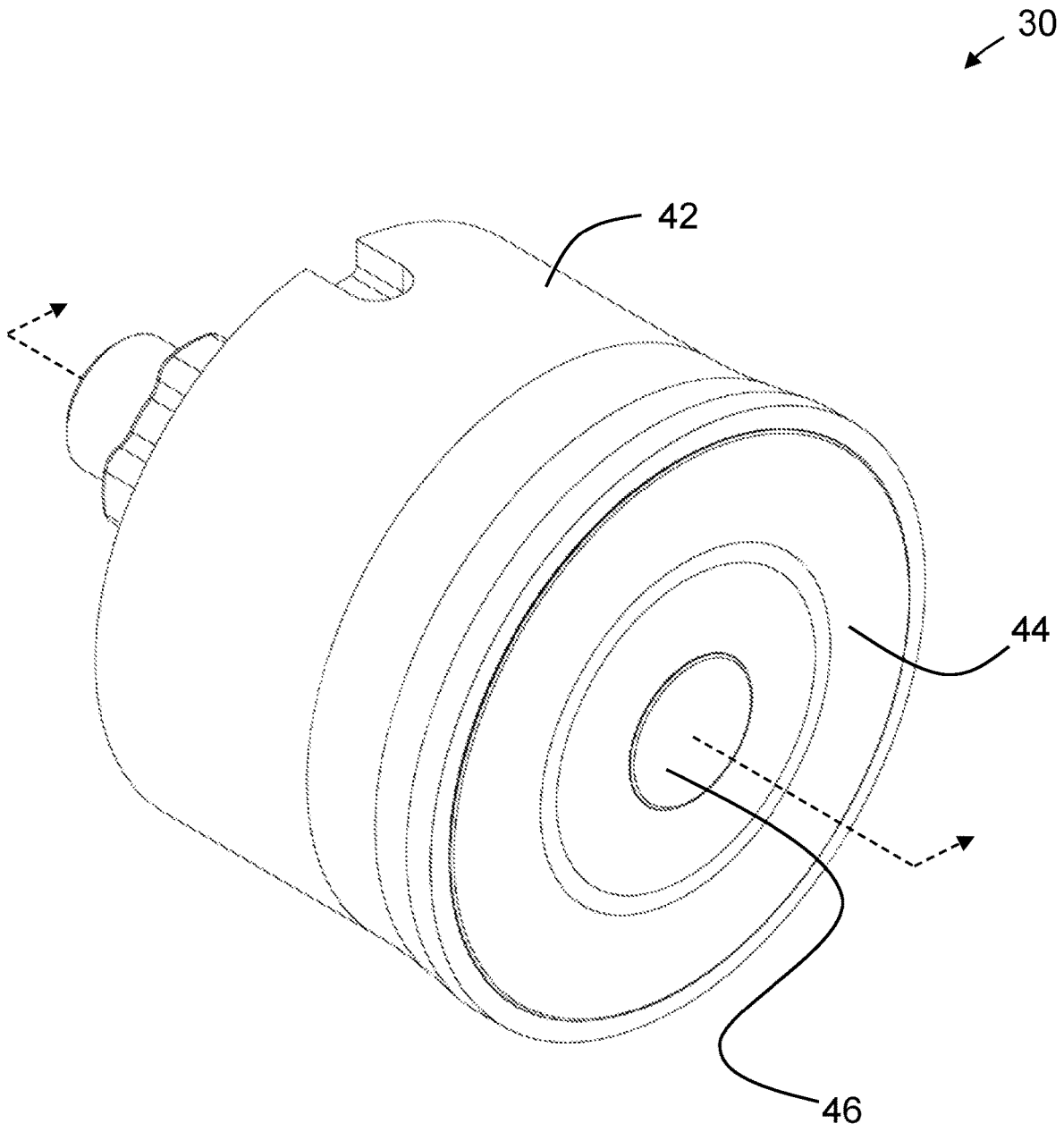
FIG. 2 is a perspective view of a dummy block forming part of the metal extrusion press of FIG. 1.
Figure 3:
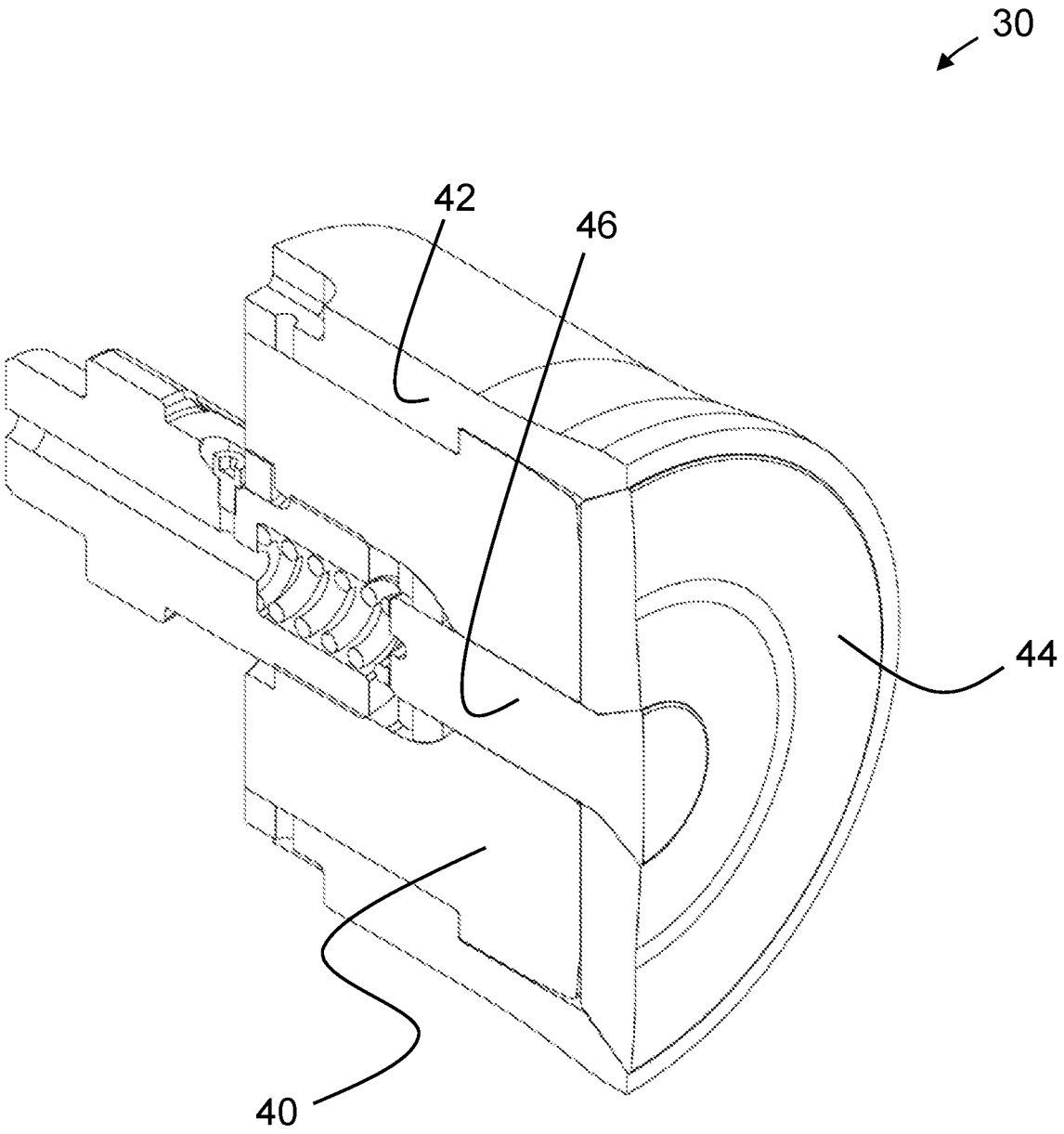
FIG. 3 is a perspective sectional view of the dummy block of FIG. 2, taken along the indicated section line.

The foregoing summary, as well as the following detailed description of certain examples will be better understood when read in conjunction with the appended drawings. As used herein, an element or feature introduced in the singular and preceded by the word "a" or "an" should be understood as not necessarily excluding the plural of the elements or features. Further, references to "one example" or "one embodiment" are not intended to be interpreted as excluding the existence of additional examples or embodiments that also incorporate the described elements or features. Moreover, unless explicitly stated to the contrary, examples or embodiments "comprising" or "having" or "including" an element or feature or a plurality of elements or features having a particular property may include additional elements or features not having that property. Also, it will be appreciated that the terms "comprises", "has", "includes" means "including by not limited to" and the terms "comprising", "having" and "including" have equivalent meanings.

As used herein, the term "and/or" can include any and all combinations of one or more of the associated listed elements or features.

It will be understood that when an element or feature is referred to as being "on", "attached" to, "connected" to, "coupled" with, "contacting", etc. another element or feature, that element or feature can be directly on, attached to, connected to, coupled with or contacting the other element or feature or intervening elements may also be present. In contrast, when an element or feature is referred to as being, for example, "directly on", "directly attached" to, "directly connected" to, "directly coupled" with or "directly contacting" another element of feature, there are no intervening elements or features present.

It will be understood that spatially relative terms, such as "under", "below", "lower", "over", "above", "upper", "front", "back" and the like, may be used herein for ease of description to describe the relationship of an element or feature to another element or feature as illustrated in the drawings. The spatially relative terms can however, encompass different orientations in use or operation in addition to the orientation depicted in the drawings.

Turning now to the drawings, FIG. 1 shows a simplified illustration of an extrusion press for use in metal extrusion. The extrusion press comprises a container 20 having an outer mantle 22 that surrounds an inner tubular liner 24. The container 20 serves as a temperature controlled enclosure for a billet 26 during extrusion of the billet. An extrusion ram 28 is positioned adjacent one end of the container 20. The end of the extrusion ram 28 has a dummy block 30 coupled thereto, which is configured to abut the billet 26 for advancing the billet through the container 20. An extrusion die 32 is positioned adjacent a die end 34 of the container 20.

During operation, once the billet 26 is heated to a desired extrusion temperature (typically 800-900° F. for aluminum), it is delivered to the extrusion press. The extrusion ram 28 with the dummy block 30 coupled thereto are then advanced, so as to push the billet 26 through the container and towards the extrusion die 32. Under the pressure exerted by the advancing extrusion ram 28 and dummy block 30, the billet 26 is extruded through the profile provided in the extrusion die 32 until all or most of the billet material is pushed out of the container 20, resulting in an extruded product 36.

The dummy block 30 may be better seen in FIGS. 2 to 6. The dummy block 30 comprises an inner dummy block base 40, an outer collar 42 coupled to the dummy block base 40 by shrink-fitting, a plunger disc 44 positioned forward of the dummy block base 40 and seated against the collar 42, and a moveable, axial plunger shaft 46 seated against and extending through the plunger disc 44 and coupled to an interior of the dummy block base 40. During use, when the dummy block 30 abuts a billet 26, the plunger shaft 46 and plunger disc 44 are configured to move rearwardly, and the plunger disc 44 is configured to elastically deform outwardly, which in turn causes a forward portion of the collar 42 to elastically deform outwardly.

The dummy block base 40 comprises a generally cylindrical body, and has a circumferential flange 48 extending outwardly in the radial direction from a forward end thereof. The dummy block base 40 has a forward surface 50, a portion of which is defined by the circumferential flange 48, which has a circumferential outer surface 52. The dummy block base 40 has a center bore 54 formed therein, which extends in the axial direction from the forward surface 50 to a central recess 56. The center bore 54 and the central recess 56 are sized to accommodate a cylindrical post of the moveable plunger shaft 46, described below. A plurality of threads 62 are formed on an interior surface defining the central recess 56, which are configured to engage complimentary outer threads 64 formed on an exterior surface of a stem 66 of a stud 68 or other elongate projection. The stem 66 has a central recess 70 for accommodating a spring 72 that is configured to provide a biasing force urging the plunger shaft 46 away from the dummy block base 40. The stud 68 or other elongate projection is mounted on a forward end of the extrusion ram 28, and comprises four (4) spaced-apart lugs 74 that are configured to abut corresponding features (not shown) of the extrusion ram 28 to provide a bayonet-style connection.

Figure 4:
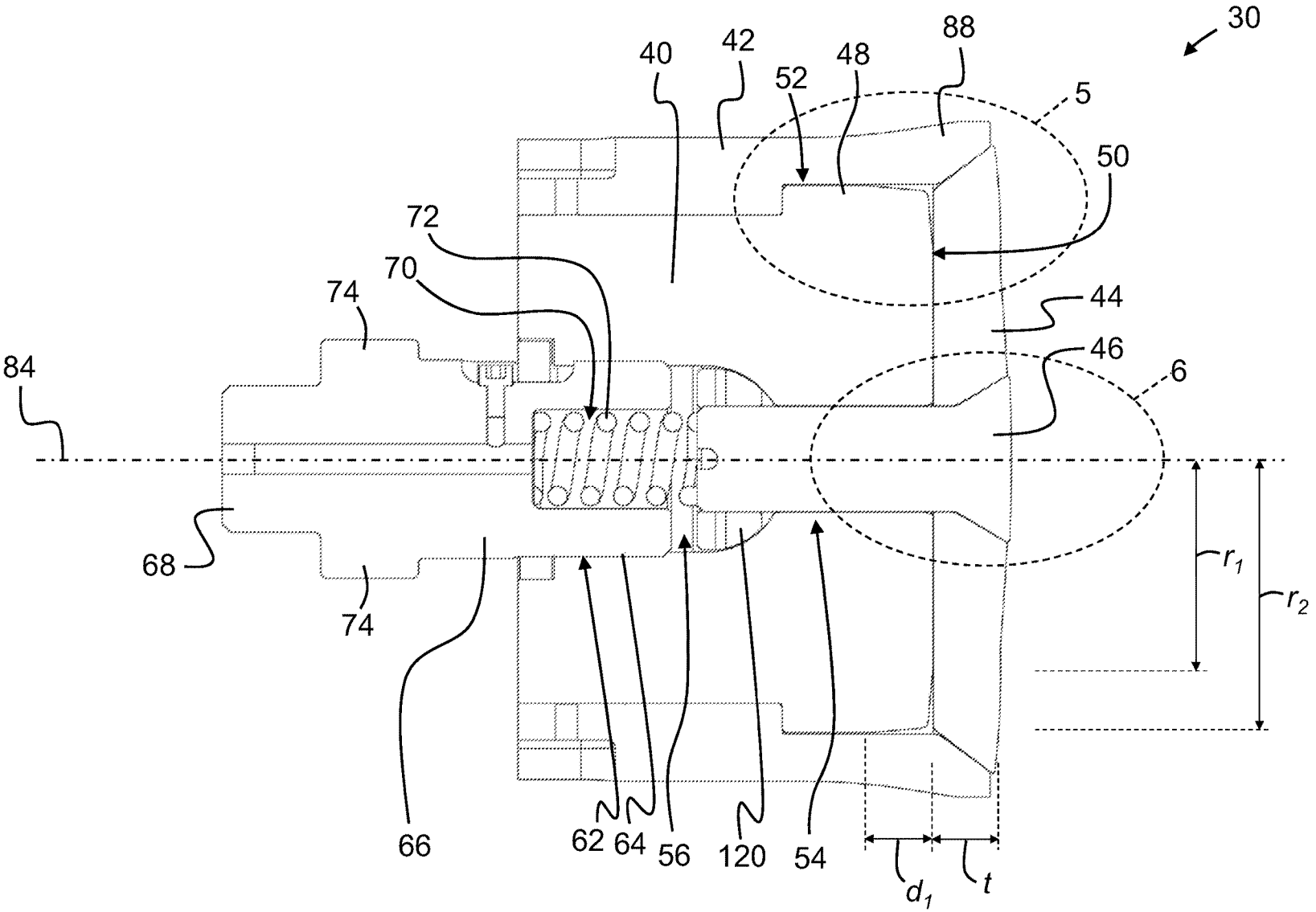
FIG. 4 is a side sectional view of the dummy block of FIG. 2, taken along the indicated section line.
Figure 5:
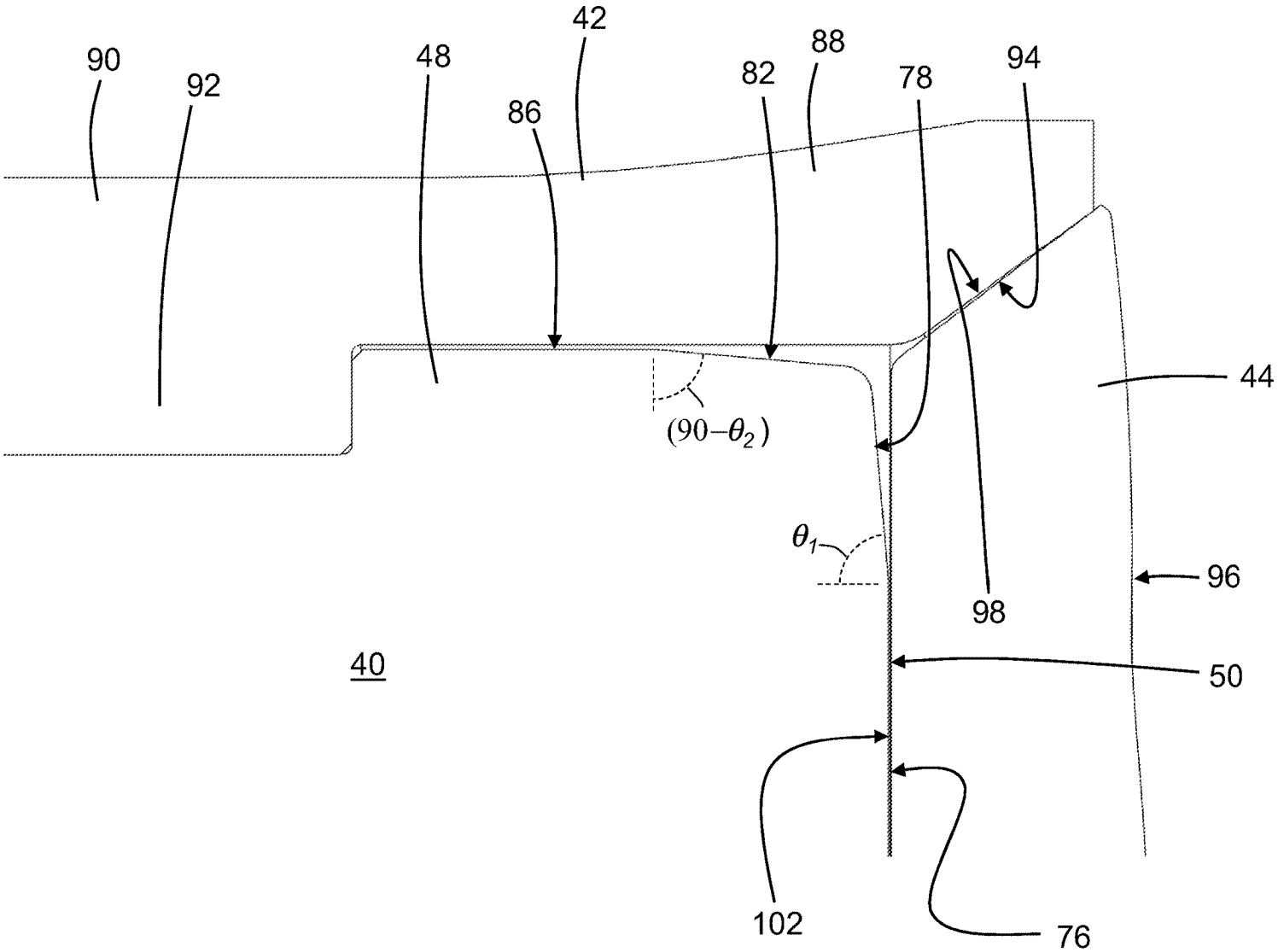
FIG. 5 is an enlarged fragmentary view of a portion of the dummy block of FIG. 4 identified by reference numeral 5.
Figure 6:
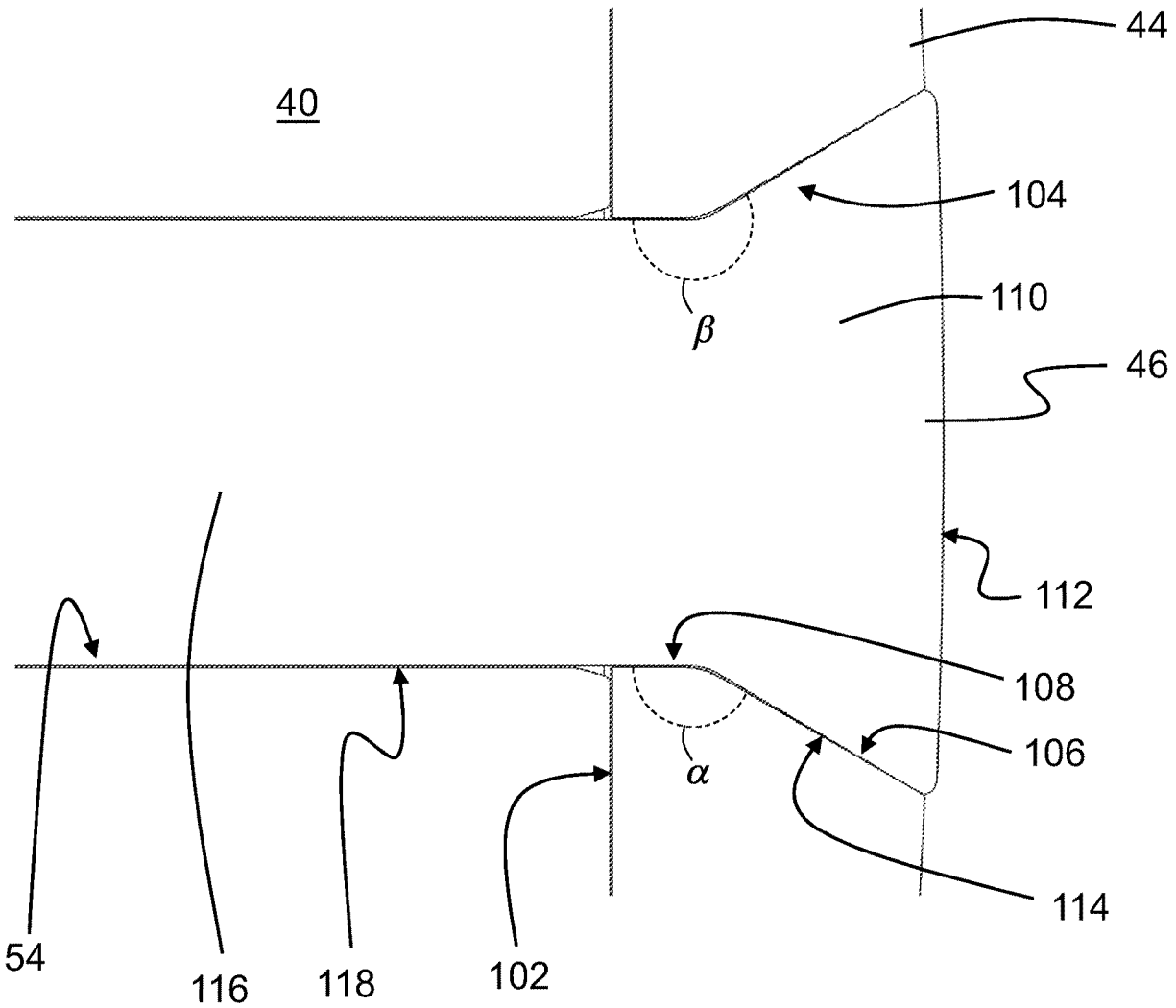
FIG. 6 is an enlarged fragmentary view of another portion of the dummy block of FIG. 4 identified by reference numeral 6.

The forward surface 50 of the dummy block base 40 has a planar central portion 76, and a beveled portion 78 that surrounds the central portion 76 and that defines an angle $\theta_1$ with the center axis 84 of the dummy block 30. In the example shown, the angle $\theta_1$ has a value of about 85 degrees. The central portion 76 defines a majority of the area of the forward surface 50. As shown in FIG. 4, the forward surface 50 is planar at radial positions r, as measured from the center axis 84 of the dummy block 30, of $r_b<r<r_1$, where $r_b$ is the radius of the center bore 54, and the forward surface 50 is beveled at radial positions r of $r>r_1$. Also in the example shown, the value of $r_1/R$, where R is the radius of the cylindrical portion 86 of the outer surface 52 of the circumferential flange 48, is about 0.75. The outer surface 52 of the circumferential flange 48 has a forward beveled portion 82 that defines an angle $\theta_2$ with the center axis 84 of the dummy block 30, and a rear cylindrical portion 86. In the example shown, the angle $\theta_2$ has a value of about 5 degrees. As shown in FIG. 4, the outer surface 52 is beveled at axial positions d, as measured from the planar central portion 76 of the forward surface 50, of $d<d_1$, and the outer surface 52 is cylindrical at axial positions d of $d>d_1$. As will be understood, the beveled portion 78 of the forward surface 50 accommodates elastic deformation of the plunger disc 44 during operation. Additionally, the beveled portions 78 and 82 accommodate elastic deformation, or "mushrooming", of the outer forward portion of the dummy block base 40 during operation.

The collar 42 comprises a generally annular body having a unitary construction and fabricated of a single piece of material. The collar 42 comprises an elastically deformable forward portion 88 having reduced thickness, and a rear portion 90 that is coupled to the dummy block base 40 by shrink-fitting. As a result, the forward portion 88 is effectively cantilevered with respect to the dummy block base 40. The rear portion 90 has an inwardly extending, inner circumferential rib 92 that is shaped to abut a rear surface of the circumferential flange 48, such that the dummy block base 40 and the collar 42 overlap in the axial direction and are thereby interlocked. In particular, the circumferential rib 92 has a forward surface abutting a rear surface of the circumferential flange 48, and an inner surface abutting an outer surface of the dummy block base 40. The forward portion 88 of the collar 42 has a frustoconical inner surface 94 that is inclined relative to the center axis 84 of the dummy block 30, and which defines a first angle with the center axis 84.

The plunger disc 44 has a generally convex forward face 96 that is configured to abut a billet 26, a frustoconical outer surface 98, and a planar rear surface 102 that is configured to abut the forward surface 50 of the dummy block base 40 during operation. Although not easily visible in FIGS. 2 to 6, the assembled dummy block 30 is configured such that, when assembled, the planar rear surface 102 of the plunger disc 44 is spaced from the planar central portion 76 of the forward surface 50 of the dummy block base 40 by a narrow gap, and in this example the gap is about 0.01 inches (about 0.254 mm). The frustoconical outer surface 98 is inclined relative to the center axis 84 of the dummy block 30, such that the frustoconical outer surface 98 defines a second angle with the center axis 84. The plunger disc 44 has a central, beveled bore 104 formed therein for accommodating the plunger shaft 46. The beveled bore 104 extends through the plunger disc 44 from the forward face 96 to the planar rear surface 102, and defines a forward frustoconical surface 106 and a rear cylindrical surface 108.

The second angle defined by the conical outer surface 98 and the center axis 84 of the dummy block 30 is slightly greater than the first angle defined by the frustoconical inner surface 94 and the center axis 84, to ensure that the plunger 46 and the collar 42 do not become jammed during use. In the embodiment shown, the difference between the second angle and the first angle is about 1.0 degrees. As will be understood, if the angle of inclination of the conical outer surface 98 were the same as, or less than, the angle of inclination of the frustoconical inner surface 94, these surfaces would jam as the plunger moves rearward into the collar 42 such that when the dummy block is removed from the container, the spring 72 would not have sufficient force to return the plunger 46 to its initial position.

The planar rear surface 102 of the plunger disc 44 has a radius $r_2$, as measured from the center axis 84. Although the forward face 96 is generally convex, the curvature is slight and as a result the thickness of the plunger disc 44 is nearly uniform across its diameter. The plunger disc 44 has a thickness, t, at the radius $r_2$. In the example shown, the plunger disc 44 has an aspect ratio, $A=(t/2\cdot r_2)$, of about 0.12. As will be understood, the relatively low value of aspect ratio A, as compared to plungers of conventional dummy blocks, allows the plunger disc 44 to flex easily and to remain in the elastic regime during operation.

The plunger shaft 46 comprises a forward, generally frustoconical portion 110 defining a convex forward face 112 and a frustoconical surface 114, and a cylindrical post 116 extending rearwardly from the frustoconical portion 110 and defining a cylindrical surface 118. The cylindrical post 116 is sized to extend through the center bore 54 and into the central recess 56 of the dummy block base 40. A connector 120 is fastened to a distal end of the post 96 within the central recess 56 for coupling the moveable plunger 46 to the dummy block base 40, and for providing a surface against which the spring 72 abuts.

At the transition in shape between the frustoconical portion 110 and the cylindrical post 116, the frustoconical surface 114 and the cylindrical surface 118 define an obtuse angle $\alpha$, where $90<\alpha<180$ degrees. In the example shown, the angle $\alpha$ has a value of about 150 degrees. As will be understood, the obtuseness of the angle $\alpha$ allows stress concentrations existing between the plunger shaft 46 and the plunger disc 44, and stress concentrations existing within the plunger shaft 46 between the frustoconical portion 110 and the cylindrical post 116, to be greatly reduced. In a complementary manner, the forward frustoconical surface 106 and the rear cylindrical surface 108 of the beveled bore 104 formed in the plunger disc 44 define an angle $\beta$ therebetween, where $\beta=(360-\alpha)$, which in the example shown has a value of about 210 degrees.

During use, the extrusion ram 28 with the assembled dummy block 30 and stud 68 mounted thereon is advanced through a container 20 to force a billet 26 through the extrusion die 32. A forward force is applied by the extrusion ram 28 to the billet 26 via the dummy block 30. In return, an opposing force is applied by the billet 26 to the dummy block 30, which causes the plunger disc 44 and the plunger shaft 46 to move rearwardly toward the dummy block base 40. During this rearward motion, the plunger disc 44 abuts against the dummy block base 40 and undergoes elastic deformation in the outward direction, which in turn applies pressure against the frustoconical inner surface 94 of the collar 42, causing the forward portion 88 collar 42 to elastically expand and deform outwardly. With the energy of impact with the billet absorbed by the elastic deformation, the force applied by the extrusion ram 28 can be transferred directly through the core of the dummy block 30 to the billet. At the end of the stroke, the extrusion ram 28 with the dummy block 30 mounted thereon is returned to its starting position in the container 20 to receive the next billet. With the opposing force previously applied by the billet 26 now removed, the spring 72 pushes the plunger shaft 46 forward to its initial position, and the elasticity of the plunger disc 44 returns the plunger disc 44 to its original shape, which in turn causes the forward portion 88 of the collar 42 to elastically return to its original shape.

As will be appreciated, the thin profile of the plunger disc 44, and specifically the low values of thickness t and aspect ratio A, advantageously allow the plunger disc 44 to be flexible and to more easily deform elastically during operation, as compared to plungers of conventional dummy blocks. Additionally, the low values of thickness t and aspect ratio A enable the plunger disc 44 to more easily remain in the elastic deformation regime and not enter the plastic deformation regime, as compared to plungers of conventional dummy blocks.

As will be appreciated, constructing the plunger disc 44 and the plunger shaft 46 as separate components allows the plunger disc 44 to be readily replaced, such as due to wear or damage, while allowing the plunger shaft 46 to be reused. This advantageously lowers the cost of repair and maintenance of the dummy block 30, as compared to conventional single-piece plungers of conventional dummy blocks.

Additionally, and as will be appreciated, constructing the plunger disc 44 and the plunger shaft 46 as separate components allows an obtuse angle to be incorporated into the shapes of these components, which advantageously allows stress concentrations between the plunger shaft 46 and the plunger disc 44 to be greatly reduced, as compared to conventional single-piece plungers of conventional dummy blocks. Further, the obtuse angle between the frustoconical portion 110 and the cylindrical post 116 advantageously allows stress concentrations within the plunger shaft 46 itself to be greatly reduced, as compared with other possible shapes of plunger shaft.

As will be appreciated, the configuration of the dummy block 30, and in particular the coupling of the dummy block base 40 and the collar 42, eliminates the need for lengthy bayonet connector lugs extending from the base that would otherwise be needed to for a conventional bayonet-style connection. As a result, the diameter of the dummy block base 40, and in turn the contact area between the dummy block base 40 and the plunger disc 44 (sometimes referred to as "pad area"), are greater than those of conventional dummy blocks. Additionally, and as will be appreciated, the circumferential flange 48 advantageously contributes to the increased pad area. The increased pad area advantageously allows a greater force applied by the extrusion ram 28 to be transferred through the core of the dummy block 30 to the billet 26, as compared to conventional dummy blocks having bayonet-style connections. This configuration advantageously enables the dummy block 30 to be operated at higher extrusion pressures than conventional dummy blocks.

The dummy block may be differently configured. For example, although in the example described above, the plunger disc 44 has an aspect ratio, $A=(t/2\cdot r_2)$, of about 0.12, the dummy block may alternatively be configured such that the plunger disc preferably has an aspect ratio of an $0.09<A<0.15$. In other examples, other suitable values of aspect ratio, A may be used, provided the aspect ratio allows the plunger disc 44 to flex easily and to remain in the elastic regime during operation.

Although in the embodiment described above, the collar is coupled to the dummy block base by shrink-fitting, in other embodiments, the collar may alternatively be coupled to the dummy block base in other ways, such as by one or more fasteners, for example.

Although embodiments have been described above with reference to the accompanying drawings, those of skill in the art will appreciate that variations and modifications may be made without departing from the scope thereof as defined by the appended claims.

What is claimed is:

1. A dummy block for a metal extrusion press comprising:

a cylindrical base having a forward surface and an outwardly extending circumferential flange;

an expandable collar coupled to the base, the collar having an inwardly extending circumferential rib abutting the circumferential flange;

a plunger disc seated against the forward surface of the base and accommodated by the collar; and a plunger shaft extending through the plunger disc and coupled to the base, wherein the circumferential flange of the base has an outer surface having a rear cylindrical portion and a forward bevelled portion, and wherein the forward surface of the base comprises a planar central portion, and a beveled portion surrounding the central portion.

2. The dummy block of claim 1, wherein the plunger disc and the plunger shaft are separate components.

3. The dummy block of claim 1, wherein the plunger shaft has a cylindrical portion and a frustoconical portion, the cylindrical portion and the frustoconical portion defining an obtuse angle therebetween.

4. The dummy block of claim 1, wherein the plunger disc has a beveled bore formed therein, the beveled bore being shaped to receive the plunger shaft.

5. The dummy block of claim 4, wherein the beveled bore defines a frustoconical surface, and wherein the plunger shaft has a frustoconical portion configured to abut the frustoconical surface of the beveled bore of the plunger disc.

6. The dummy block of claim 1, wherein the collar comprises a rear portion coupled to the base, and a forward portion configured to elastically deform outwardly.

7. The dummy block of claim 6, wherein a wall thickness of the rear portion is greater than a wall thickness of the forward portion.

8. The dummy block of claim 6, wherein the forward portion abuts an outer surface of the plunger disc.

9. The dummy block of claim 1, wherein the plunger disc has a rear surface that is parallel to the planar central portion of the forward surface of the base.

10. The dummy block of claim 9, wherein the rear surface is non-parallel to the beveled portion of the forward surface of the base.

* * * * *